United States Patent [19]

Hamada et al.

[11] Patent Number: 4,755,101

[45] Date of Patent: Jul. 5, 1988

[54] DEVICE FOR REMOVABLY ATTACHING FRONT LOADER TO VEHICLE

[75] Inventors: Akio Hamada; Masami Hirooka, both of Osaka, Japan

[73] Assignee: Kubota Ltd., Osaka, Japan

[21] Appl. No.: 40,801

[22] Filed: Apr. 21, 1987

[30] Foreign Application Priority Data

Jun. 4, 1986 [JP] Japan ..... 61-130650
Jun. 7, 1986 [JP] Japan ..... 61-87681[U]

[51] Int. Cl.[4] ..... B66C 23/00
[52] U.S. Cl. ..... 414/686; 172/274
[58] Field of Search ..... 414/686; 172/272, 273, 172/274

[56] References Cited

U.S. PATENT DOCUMENTS 4,217,075 8/1980 Frank ..... 172/274 X
4,337,015 6/1982 Friesen et al. ..... 414/686
4,470,751 9/1984 Masuzawa et al. ..... 172/274 X

FOREIGN PATENT DOCUMENTS 1915580 3/1970 Fed. Rep. of Germany ..... 414/686
6096454 12/1983 Japan .
6409106 8/1964 Netherlands ..... 414/686
213937 6/1967 Sweden ..... 414/686

*Primary Examiner*—Frank E. Werner
*Assistant Examiner*—Jennifer Doyle
*Attorney, Agent, or Firm*—Birch, Stewart, Kolasch & Birch

[57] ABSTRACT

The body of a vehicle is provided at a side portion thereof with a mount frame having a mount portion for a front loader. The front loader has a mast removably attachable to the mount portion, a lift arm supported by the mast, a lift cylinder connected between the mast and the lift arm, a working portion pivotably supported by the front end of the lift arm, a work cylinder connected between the lift arm and the working portion, and a brace removably connectable between the mast and a front side portion of the vehicle body. When the front loader is to be attached to or removed from the vehicle body, the brace is removably attached to the lift arm or to the working portion, and with the brace and the working portion placed on the ground, the work cylinder is extended or contracted, lowering or raising the lift arm and the mast, whereby the mast is shifted between an attached position on the mount portion and a removed position thereabove.

10 Claims, 7 Drawing Sheets

DEVICE FOR REMOVABLY ATTACHING FRONT LOADER TO VEHICLE

FIELD OF THE INVENTION AND RELATED ART STATEMENT

The present invention relates to a front loader attaching device, and more particularly to a device for removably attaching a front loader to the body of a vehicle.

Unexamined Japanese Utility Model Publication No. SHO 60-96454, for example, discloses a device for removably attaching a front loader to the body of a tractor.

The disclosed device comprises a pair of mount frames each having a front loader mount portion at each side of the tractor body. The front loader comprises a pair of opposite masts each removably attachable in an upright position to the mount portion, a pair of opposite lift arms supported on the pair of masts respectively by a lateral pivot, a pair of opposite lift cylinders each connected between the mast and the lift arm for raising and lowering the lift arm, a bucket supported on the front ends of the lift arms by a lateral pivot, a pair of opposite bucket cylinders each connected between the bucket and the lift arm for pivotally moving the bucket, and a pair of opposite braces each projecting forward from the mast and removably attachable at its front end to a front side portion of the tractor body.

When the front loader is to be attached to or removed from the tractor body, a stand is removably attached to the bucket, and with the stand and the bucket placed on the ground, the bucket cylinders are extended or contracted to lower or raise the lift arms and the masts, whereby each mast is shifted between an attached position on the mount portion and a removed position thereabove.

Thus, the conventional device requires the specific stand which adds to the cost.

Further during the use of the front loader as attached to the tractor body, there is a need to stow the stand, hence cumbersomeness. Moreover, there is a likelihood that the stand will get lost.

Further when the front loader is to be removed from the tractor body, for example, at a work site, the stand must be carried to the work site. The device therefore has the problem that the front loader is not removable without the stand.

In the case of garden tractors, the tractor has a muffler and an air cleaner projecting outward from opposite sides of its front bonnet portion and arranged above the braces.

Accordingly, when the front loader is to be connected to or removed from the garden tractor, there arises a need to remove the braces to avoid the contact of the brace with the muffler or the air cleaner whereas the operator not infrequently forgets to remove the braces, permitting the brace to strike the muffler or the air cleaner and cause damage to or break it.

OBJECTS AND SUMMARY OF THE INVENTION

A first object of the present invention is to eliminate the need to prepare the specific stand and to thereby overcome the problems of cost, stowing the stand and carrying the stand.

A second object of the invention is to provide a device for removably attaching a front loader to a garden tractor without the likelihood that if the operator forgets to remove the braces, the brace will come into contact with the muffler or the air cleaner at one side of the tractor bonnet.

To fulfill these objects, the device of the present invention has the following construction.

To removably attach a front loader to the body of a vehicle, the device comprises a mount frame having a front loader mount portion at a side portion of the vehicle body. The front loader has a mast removably attachable in an upright position to the mount portion, a lift arm supported on the mast by a lateral pivot, a lift cylinder connected between the mast and the lift arm for raising and lowering the lift arm, a working portion supported on the front end of the lift arm by a lateral pivot, a work cylinder connected between the lift arm and the working portion for pivotally moving the working portion, and a brace projecting forward from the mast and removably attachable at its front end to a front side portion of the vehicle body.

The brace is removably connectable to the mast. When the front loader is to be attached to or removed from the vehicle body, the brace is removably attached to the lift arm or to the working portion, and the brace and the working portion are placed on the ground.

In this state, the work cylinder is extended or contracted, lowering or raising the lift arm and the mast, whereby the mast is shifted between an attached position on the mount portion and a removed position thereabove.

BRIEF DESCRIPTION OF THE DRAWINGS

FIG. 1 is an overall side elevation showing a tractor and a front loader;

FIG. 2 is a fragmentary plan view of the same;

FIG. 3 is a fragmentary side elevation of the same with the loader in attached state;

FIG. 4 is a similar view showing the loader as removed from the tractor;

FIG. 5 is a fragmentary perspective view;

FIG. 6 is a plan view showing a mount frame;

FIG. 7 is a rear view showing the same;

FIG. 8 is a fragmentary side elevation in vertical section of FIG. 1;

FIG. 9 is a view in section taken along the line IX—IX in FIG. 8; and

DESCRIPTION OF THE PREFERRED EMBODIMENTS

Figure 1:
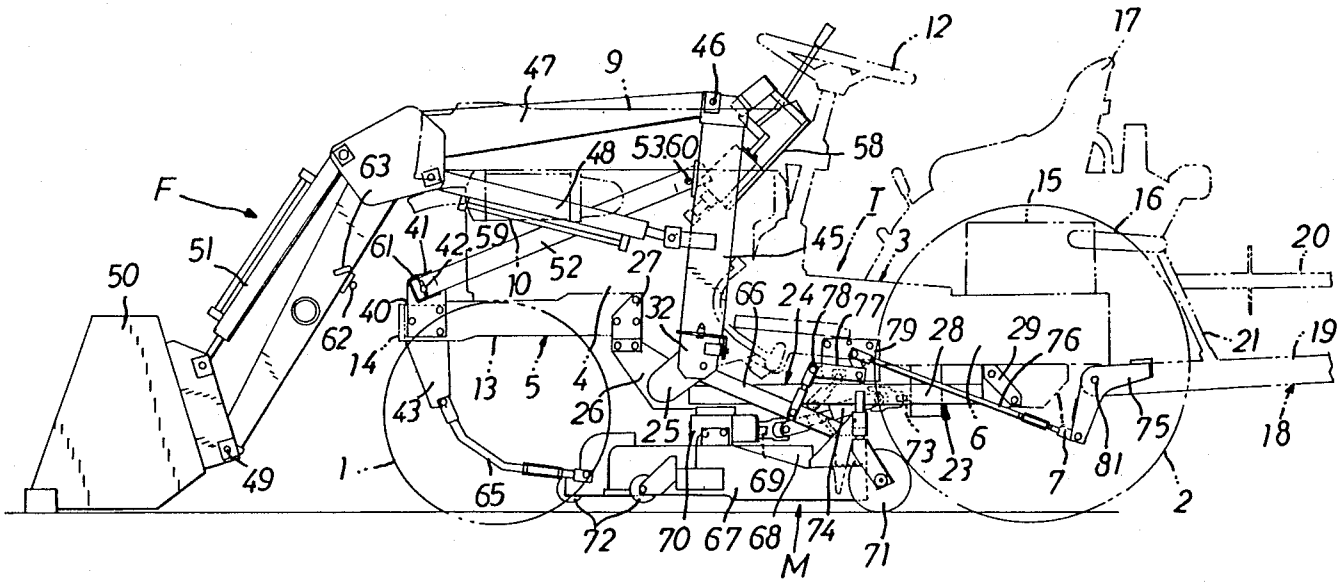
FIGS. 1 to 9 show an embodiment of the present invention.

Embodiments of the invention will be described below with reference to the drawings.

Referring to FIGS. 1 to 4, a garden tractor T has a pair of front wheels 1 and a pair of rear wheels 2. The body 3 of the tractor T comprises an engine 4, a front axle frame 5, a transmission case 6, a pair of rear axle cases 7, etc.

The engine 4 is covered with a bonnet 9 and has a muffler 10 projecting outward from the left side of the bonnet 9 and an air cleaner 11 from the right side thereof. A steering wheel 12 is provided at the rear end of the bonnet 9.

Figure 5:
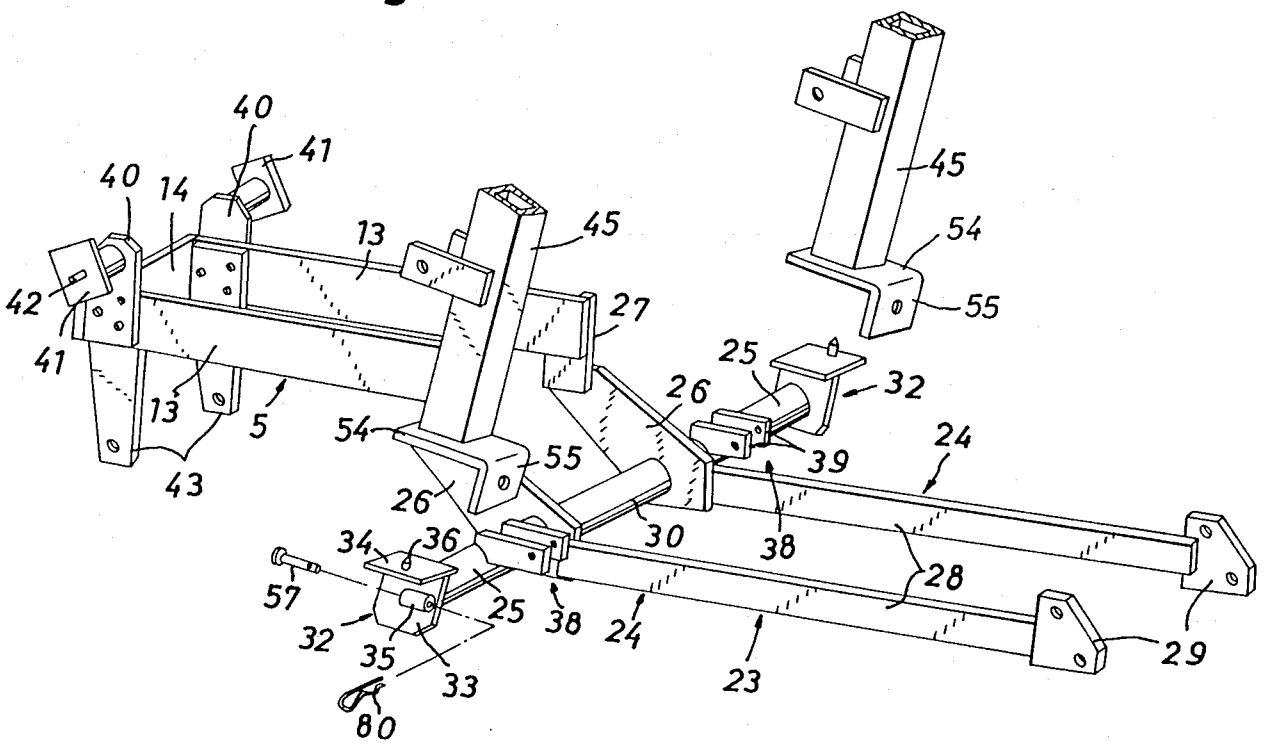

With reference also to FIG. 5, the front axle frame 5 comprises a pair of side plates 13 extending forward from opposite sides of a lower portion of the engine 4, and a bumper 14 interconnecting the front ends of the side plates 13.

The transmission case 6 has the pair of rear axle cases 7 projecting outward from opposite sides of its rear portion, and a hydraulic unit 15 on the top of the case rear portion for raising and lowering a working implement. The hydraulic unit 15 has a pair of opposite lift arms 16. A seat 17 is mounted on the top of the hydraulic unit 15.

The transmission case 6 has at its rear end a three-point link assembly 18 for removably connecting the working implement to the tractor. This assembly 18 comprises a pair of opposed lower links 19 and a single central top link 20. Each lower link 19 is connected to the lift arm 16 by a lift rod 21.

Figure 7:
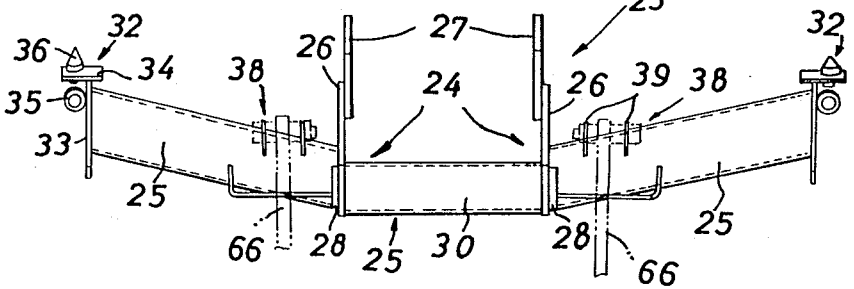
Figure 6:
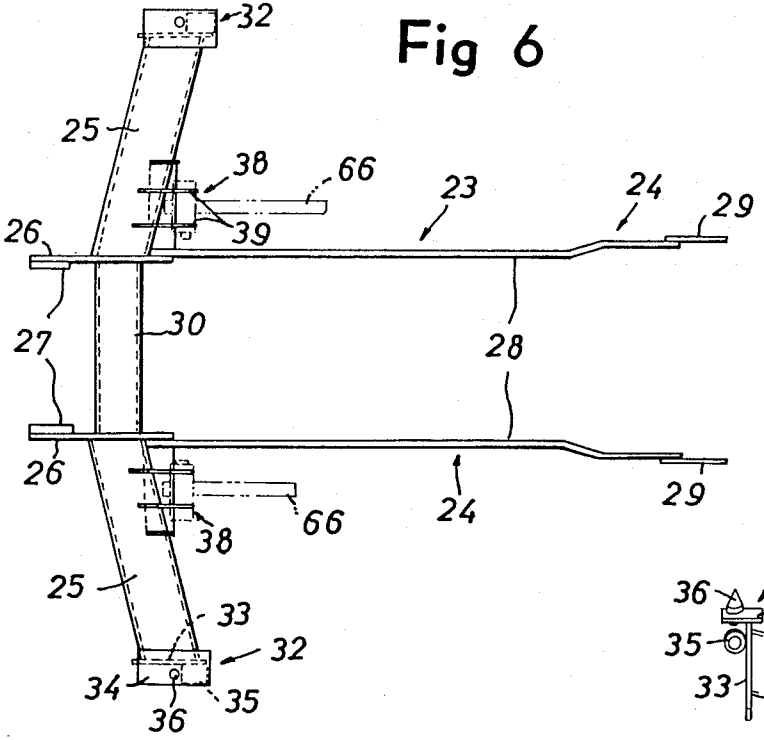

As shown also in FIGS. 5 to 7, the vehicle body 3 is removably provided with a working implement mount frame 23. The mount frame 23 comprises a pair of opposed side frame members 24, a pair of opposite projecting frame members 25 extending outward from the side frame members 24, etc.

The side frame member 24, which is provided at each side of the vehicle body 3 longitudinally thereof, comprises a forwardly upwardly slanting plate 26 toward the front, a front connecting plate 27 extending upward from the front end of the slanting plate 26 and removably attached to the rear end of the side plate 13 of the front axle frame 5, an extension plate 28 extending horizontally rearward from the rear end of the slanting plate 26, and a rear connecting plate 29 secured to the rear end of the extension plate 28 and removably fastened to the rear axle case 7. The rear ends of the opposed slanting plates 26 are interconnected by a connecting tube 30. The slanting plate 26 may be integral with the front connecting plate 27.

The projecting frame member 25 is in the form of a circular tube projecting outward from the rear end of the slanting plate 26 upwardly rearward.

Figure 9:
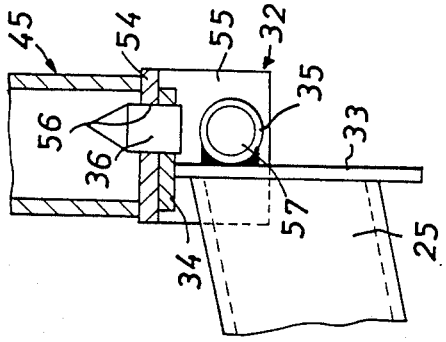
Figure 8:
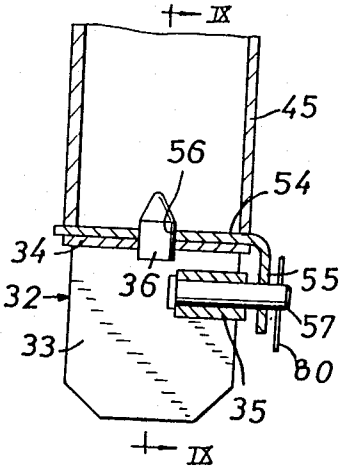

As shown also in FIGS. 8 and 9, the outer end of the projecting frame member 25 has a front loader mount portion 32 which comprises a vertical support plate 33 secured to the outer end of the frame member 25 and a flat bearing plate 34 slightly inclined forwardly upward and secured to the upper end of the support plate 33. A tube 35 slightly inclined forwardly upward is secured to a rearward upper portion of the support plate 33 on its outer side. The bearing plate 34 is left open along its entire outer periphery. A pinlike upward engaging projection 36 is mounted on the longitudinal midportion of the bearing plate 34 toward its outer side. The engaging projection 36 has a conical upper end.

The projecting frame member 25 is provided toward its inner end with a rear mount portion 38 for the working implement to be attached to the bottom of the tractor body 3. The mount portion 38 comprises a pair of side plates 39 projecting rearward from the frame member 25.

A support member 40 is removably fastened in an upright position to each side plate 13 of the front axle frame 5 on the outer side of the front plate end. The support member 40 is provided on the outer side of its upper end with a contact plate 41 and an engaging pin 42 projecting outward from the contact plate 41.

A downwardly extending front mount portion 43 for the bottom working implement is removably fastened to the inner side of the front end of each side plate 13 of the front axle frame 5. The front mount portion 43 is in the form of a plate.

A front loader F is removably attached to the tractor body 3. The front loader F comprises a pair of opposite masts 45 each removably attachable in an upright position to the front loader mount portion 32, a pair of opposite lift arms 47 supported on the pair of masts 45 respectively by a lateral pivot 46, a pair of opposite lift cylinders 48 each connected between the mast 45 and the lift arm 47 for raising and lowering the lift arm 47, a bucket 50 supported on the front ends of the lift arms 47 by a lateral pivot 49, a pair of work cylinders, i.e. bucket cylinders 51, each connected between the bucket and the lift arm 47 for pivotally moving the bucket 50, a pair of opposite braces 52 each projecting forward from the mast 45, a control unit 58, etc.

An inwardly projecting lateral connecting pin 53 is secured to an upper portion of each mast 45. As shown in FIGS. 8 and 9, the mast 45 is provided at its bottom with a flat bottom plate 54 slightly forwardly upwardly inclined and positionable on the bearing plate 34 of the mount portion 32 and with a fixing plate 55 extending downward from the rear end of the bottom plate 54 and slightly inclined rearward. These plates 54, 55 are formed by bending a single plate.

The bottom plate 54 has an engaging hole 56 for the engaging projection 36 on the front loader mount portion 32 to removably engage in. The engagement of the projection 36 in the hole 56 restrains the mast 45 from moving forward or rearward.

The fixing plate 55 is positioned at the rear side of the mount portion 32. When a lockpin 57 is removably inserted through the fixing plate 55 and the tube 35 of the mount portion 32 substantially horizontally, the pin 57 prevents the mast 45 from moving upward. A retaining pin 80 is removably inserted through the lockpin 57.

Each brace 52 is in the form of a plate and has pin holes 59, 60 in its front and rear ends. The engaging pin 42 of the support member 40 is removably inserted through the front pin hole 59, with a retaining pin 61 removably inserted through the engaging pin 42, whereby the brace 52 is prevented from slipping off the engaging pin 42. The connecting pin 53 on the mast 45 is removably inserted through the rear pin hole 60.

Each brace 52 is positioned at a lower level and toward the tractor body 3 toward the front brace end. The muffler 10 and the air cleaner 11 are arranged above the braces 52.

Figure 2:
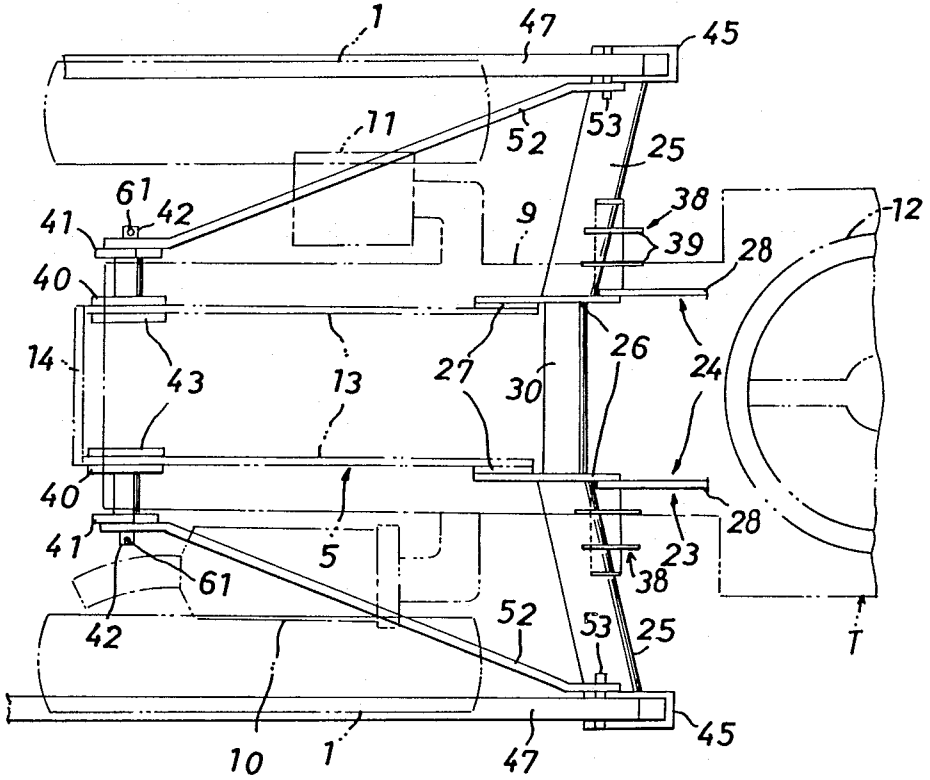
Figure 3:
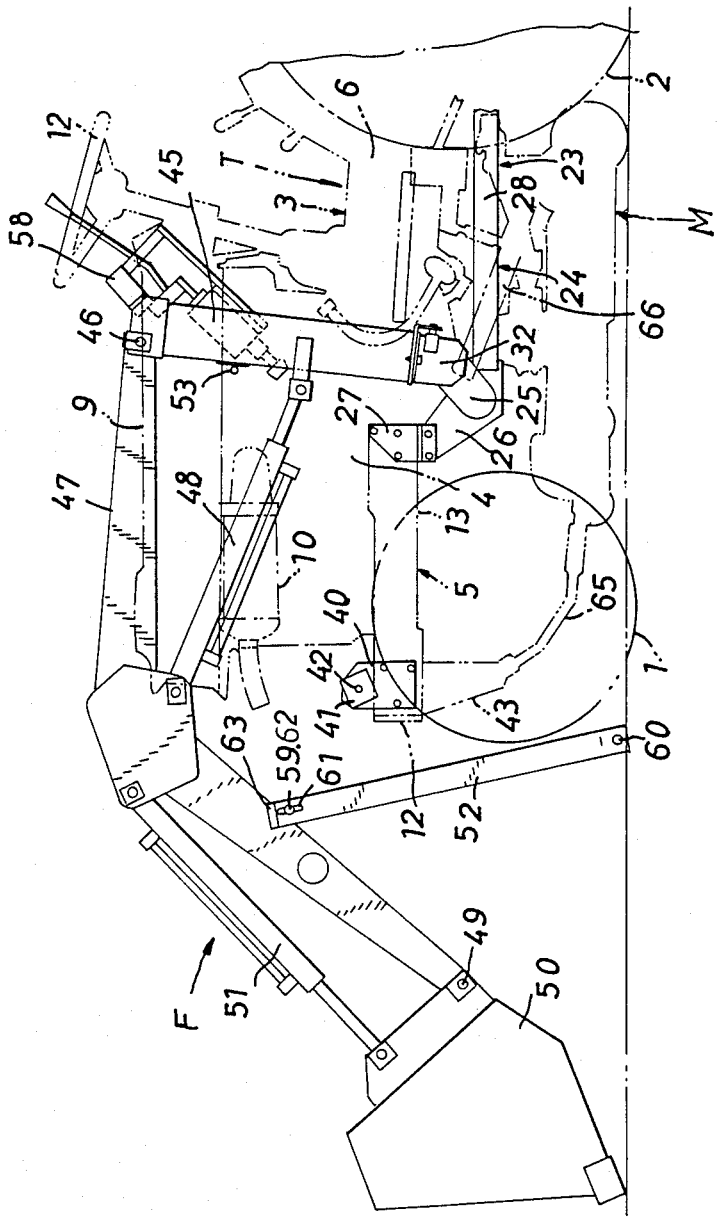
Figure 4:
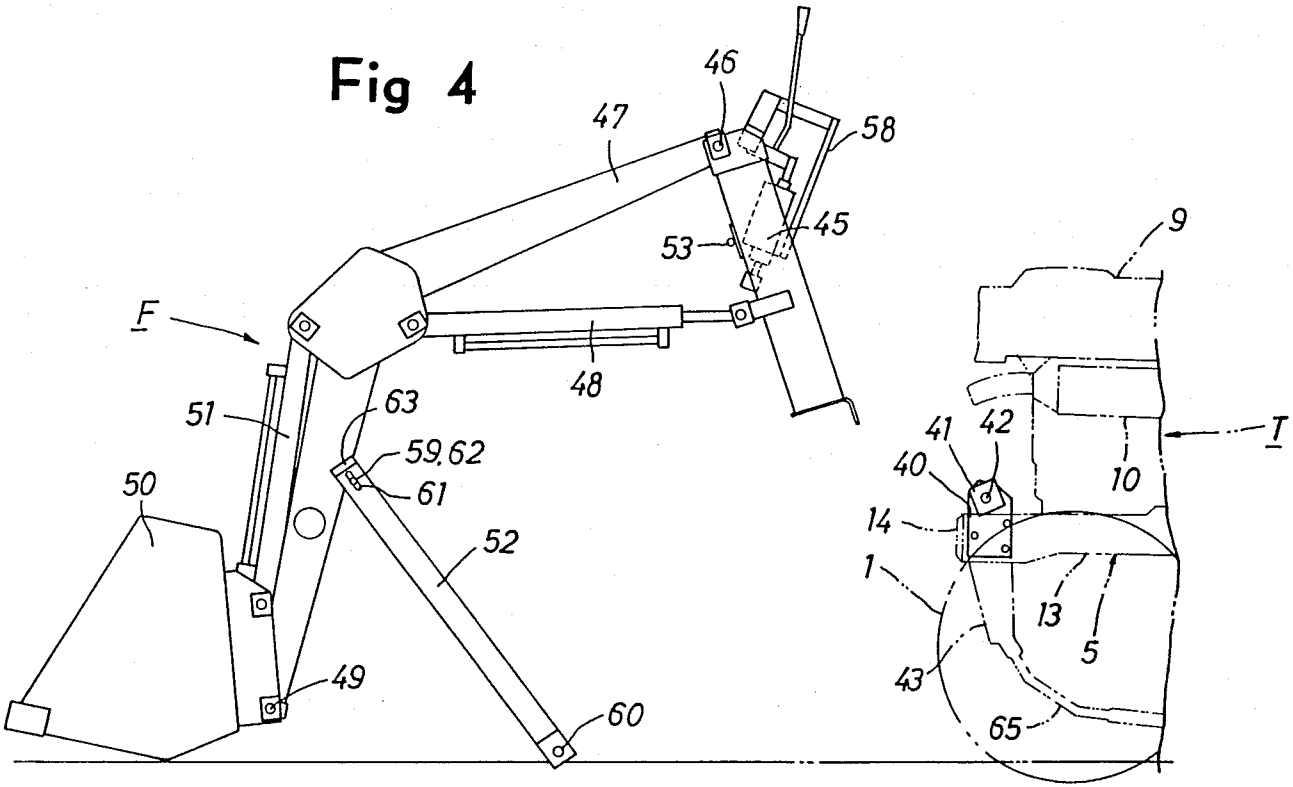

While the braces 52 serve as connectors for connecting the masts 45 to opposite sides of the front portion of the tractor body 3 as shown in FIGS. 1 and 2, the braces 52 also provide a stand for the front loader F when the loader F is to be attached to or removed from the tractor body 3 as seen in FIGS. 3 and 4.

For the braces 52 to serve as the stand, an outwardly projecting connecting pin 62 is attached to a front portion of each lift arm 47 on the lower side thereof for removably attaching the brace 52 to the arm, the pin 62 extending in a lateral direction. A stopper 63 for preventing the brace 52 from moving about the pin 62 is secured to the outer side of the front portion of the lift arm 47.

A midmount mower M, an example of aforementioned bottom working implement, is removably and vertically movably attached to the tractor body 3 by front and rear two pairs of links 65, 66. The mower M is positioned below the body 3 between the front and rear wheels 1, 2. The front ends of the front links 65 are removably pivoted to the front mount portions 43, and the rear ends of the rear links 66 to the rear mount portions 38.

The mower M compirses a mower deck 67, a plurality of cutters disposed under the deck, a belt transmission mechanism disposed above a rear portion of the mower deck 67 for driving the cutters, a cover 68 fixed to the rear portion of the deck 67 and covering the transmission mechanism, an input case 70 provided on the cover 68 and having an input shaft 69, cutting height adjusting gauge wheels 71, limit gauge wheels 72, etc. The input shaft 69 is coupled to a PTO shaft 73 of the tractor T by a universal joint shaft 74.

The rear ends of the front links 65 are removably pivoted to front end portions of the mower deck 67, and the rear ends of the rear links 66 to rear end portions of the deck 67.

A pair of pivotally movable members 75 are supported by a pivot 81 for the lower links 19 and engaged with the links 19. The movable member 75 is connected to the rear link 66 by a rear connecting rod 76, a bell crank 77 and a front connecting rod 78. Thus, the mower M is movable upward or downward by the upward or downward movement of the lower links 19 which are moved by the hydraulic unit 15. The bell crank 77 is supported by a bracket 79 fixed to the transmission case 6.

When the front loader F attached to the tractor body 3 by the foregoing embodiment is to be removed therefrom, each of the braces 52 is removed from the mast 45 and the support member 40. As shown in FIG. 3, the connecting pin 62 on the lift arm 47 is inserted through the front pin hole 59 of the brace 52, and the retaining pin 61 is then inserted through the connecting pin 62. Consequently, the brace 52 as restrained from rotation by the stopper 63 is attached to the lift arm 47 by the connecting pin 62.

Subsequently, the lift arms 47 are lowered to place the bucket 50 and the braces 52 on the ground as seen in FIG. 3.

The lockpin 57 is thereafter removed from the fixing plate 55 of each mast 45 and the tube 35 of each front loader mount portion 32 to release the mast 45 from the mount portion 32.

In this state, the bucket cylinders 51 are contracted to raise the lift arms 47 and the masts 45 while rotating the bucket 50 upward about the pivot 49, thereby shifting each mast 45 from the attached position on the mount portion 32 shown in FIG. 3 to the removed position thereabove as shown in FIG. 4 and removing the engaging projection 36 from the hole 56.

Next, the tractor T is retracted from the front loader F as shown in FIG. 4, whereby the front loader F is completely removed from the tractor body 3.

The front loader F is attached to the tractor body 3 by a procedure reverse to the above. First, the tractor T is advanced toward the front loader F from the state shown in FIG. 4 to properly position the tractor T relative to the loader F.

Next, the bucket cylinders 51 are extended to lower the lift arms 47 and the masts 45 while rotating the bucket 50 about the pivot 49, thereby shifting each mast 45 from the removed position of FIG. 4 to the attached position of FIG. 3 and engaging the projection 36 into the engaging hole 56.

Each mast 45 is then locked to the front loader mount portion 32 with the lockpin 57, and each lift arm 47 is slightly moved upward by the lift cylinder to raise the brace 52 off the ground.

Next, each brace 52 is removed from the lift arm 47 and attached to the mast 45 and the support 40, whereby the front loader F is completely attached to the tractor body 3.

Since the braces 52 are used as a stand for the front loader F when the front loader F is to be removed from or attached to the vehicle body 3, there is no need to prepare a special stand. This obviates the problem as to the cost.

Whereas the conventional stand needs to be stowed during the use of the front loader as attached to the tractor body, the present invention has overcome this cumbersome problem, while there is no likelihood that the stand members will become lost.

Further when the front loader is to be removed from the tractor, for example, at a work site, there is no need to carry the stand to the work site, hence convenience.

Further before the front loader F is attached to or removed from the tractor body 3, the braces 52 are invariably removed from the front loader F. This obviates the likelihood that the operator forgets to remove the braces 52 before the attachment or removal, permitting the braces to strike the muffler 10 and the air cleaner 11 to damage or break them.

The front loader F is removed from the tractor body 3 with the piston rods of the bucket cylinders 51 retracted to the greatest possible extent, with a diminished portion of each piston rod left exposed, so that even if the front loader F is allowed to stand in this state for a long period of time, the rod surface is less susceptible to corrosion that would cause leakage of the oil from the bucket cylinder 51.

The flat bearing plate 34 of the front loader mount portion 32 is left open at its periphery, with no upright members provided around the plate 34 for fixing the mast 45 of the loader F to the mount portion 32, so that soil, dust, etc., if deposited on the bearing plate 34, are easily removable therefrom. Consequently, the mast 45 can be attached to the mount portion 32 satisfactorily, with the joint free from soil or dust.

Figure 10:
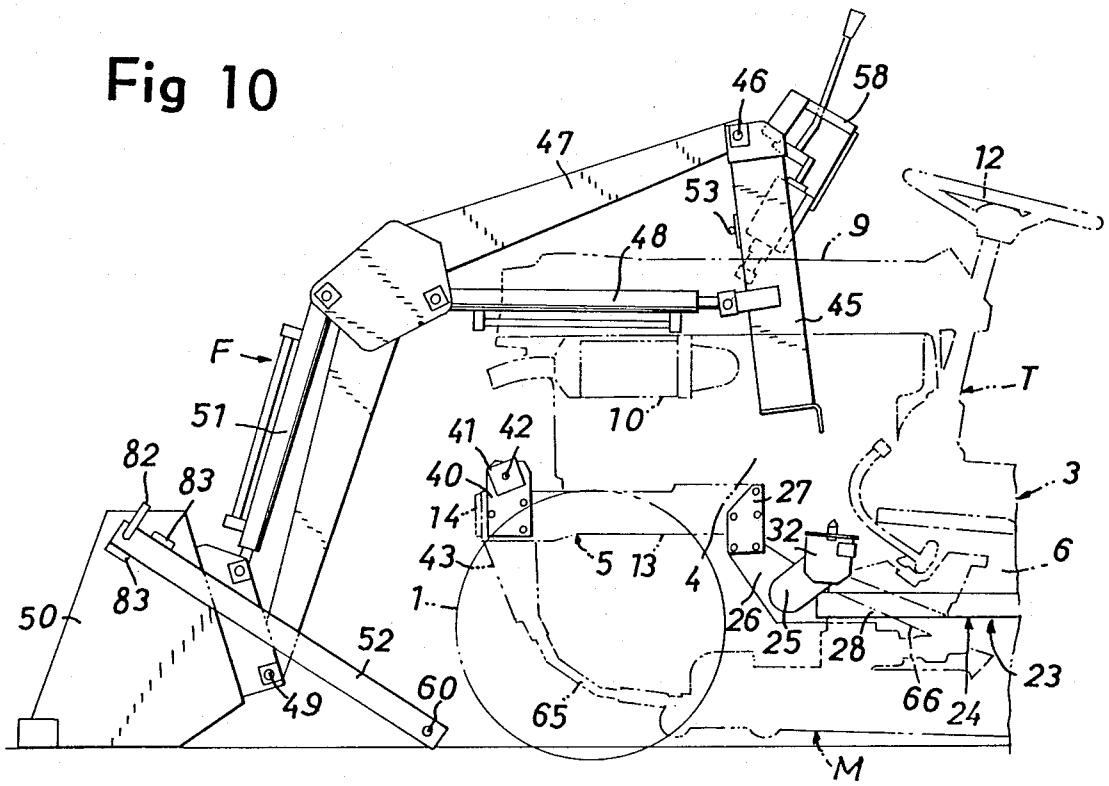
FIG. 10 is a fragmentary side elevation of another embodiment of the invention showing a tractor and a front loader as removed therefrom.

When the front loader F is to be attached to or removed from the tractor body 3 according to the invention, the braces 52, which are attached to the lift arms 47 as described above, may alternatively be removably connected to opposite sides of the bucket 50 as seen in FIG. 10.

In this case, a connecting bolt 82 is removably inserted through the front pin hole 59 of each brace 52 and is removably screwed into the outer side of the bucket 50. A stopper 83 fixed to each side of the bucket 50 prevents the brace 52 from moving about the connecting bolt 82.

Although the brace is attached to the mast, the support member and the lift arm with pins or to the bucket with a bolt according to the foregoing embodiments, the brace attaching or connecting means are not limited to these means.

While a bucket is used as the working portion according to the embodiments described, fork or the like may alternatively be used as the working portion.

The bottom working implement may be another working implement other than the mid-mount mower.

The front loader may be attached to a vehicle other than the tractor.

What is claimed is:

1. A device for removably attaching a front loader to a vehicle, the device including a mount frame having a front loader mount portion at a side portion of the body of the vehicle, the front loader having a mast removably attachable in an upright position to the mount portion, a lift arm supported on the mast by a lateral pivot, a lift cylinder connected between the mast and the lift arm for raising and lowering the lift arm, a working portion supported on the front end of the lift arm by a lateral pivot, a work cylinder operatively connected between the lift arm and the working portion for pivotally moving the working portion, and a brace removably connected at its rear end to the mast and projecting forward from the mast and removably attachable at its front end to a front side portion of the vehicle body, the device being characterized in that the brace is removed from the mast and is removably attached to the lift arm or the working portion and used as a support stand when the front loader is to be attached to or removed from the vehicle body, the mast being shiftable between an attached position on the mount portion and a removed position thereabove when the lift arm and the mast are raised or lowered by contracting or extending the work cylinder while the brace and the working portion are on the ground.

2. A device as defined in claim 1 wherein a mount frame, a mast, a lift arm, a lift cylinder and a work cylinder are provided at each side of the vehicle body or the front loader to pair with those on the other side thereof.

3. A device as defined in claim 2 wherein a muffler and an air cleaner project outward from opposite sides of a bonnet in the front portion of the vehicle, and are positioned above the braces.

4. A device as defined in claim 3 wherein each of the braces is removably attached to an upper portion of the mast with a pin, and the brace is positioned at a lower level and toward the vehicle body as the brace extends toward its front end, the opposite braces being removably attached at their front ends to a pair of opposed support members secured to a front axle frame of the vehicle.

5. A device as defined in claim 4 wherein when the front loader is to be attached to or removed from the vehicle body, each of the braces is attached to the lift arm with a pin and prevented from rotation by a stopper secured to the lift arm.

6. A device as defined in claim 4 wherein when the front loader is to be attached to or removed from the vehicle body, each of the braces is attached to each side of the working portion with a connecting bolt and prevented from rotation by a stopper secured to the working portion.

7. A device as defined in claim 2 wherein each of the mount frames comprises a side frame member provided at each side of the vehicle body and extending longitudinally thereof and a projecting frame member extending outward from the side frame member, the side frame member having a front portion attached to a front axle frame and a rear portion attached to a rear axle case, the projecting frame member being provided at its outer side with the front loader mount portion.

8. A device as defined in claim 7 wherein the front loader mount portion comprises a vertical support plate secured to the outer end of the projecting frame member, a bearing plate slightly inclined forwardly upward and secured to the upper end of the support plate, and a tube secured to the outer side of the support plate and slightly inclined forwardly upward, the bearing plate being left open at its entire periphery, a pinlike upward engaging projection being mounted on the longitudinal midportion of the bearing plate toward its outer side and having a conical upper portion.

9. A device as defined in claim 8 wherein the mast is slightly inclined rearward, has a bottom plate slightly forwardly upwardly inclined and positionable on the bearing plate of the front loader mount portion, a fixing plate extending downward from the rear end of the bottom plate and slightly inclined rearward, the bottom plate and the fixing plate being formed by bending a single flat plate, the bottom plate being formed in its outward longitudinal midportion with an engaging hole for the engaging projection to removably engage in, a lockpin being removably insertable through the fixing plate and the tube of the front loader mount portion.

10. A device as defined in claim 7 wherein a pair of front mount portions for a bottom working implement are provided at opposite sides of the vehicle body at its front portion, and a pair of rear mount portions for the bottom working implement are provided on the opposite projecting frame members on the inner side thereof, the bottom working implement being a midmount mower upwardly and downwardly movably attached to the front and rear mount portions by a pair of front links and a pair of rear links respectively, the vehicle body being provided with a lift unit for raising and lowering the mid-mount mower.

* * * * *